US006448518B1

(12) United States Patent
Martin et al.

(10) Patent No.: US 6,448,518 B1
(45) Date of Patent: Sep. 10, 2002

(54) RESISTIVE SWITCH PAD

(75) Inventors: Glen W. Martin, Kokomo, IN (US); Joseph J. Wiles, Walton, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/877,701

(22) Filed: Jun. 11, 2001

(51) Int. Cl.[7] ..... H01H 9/00
(52) U.S. Cl. ..... 200/292; 200/512; 200/275
(58) Field of Search ..... 200/275, 276.1, 200/512, 516, 534, 292, 524

(56) References Cited

U.S. PATENT DOCUMENTS 3,171,905 A * 3/1965 Rubio et al. ..... 200/11
4,135,065 A * 1/1979 Nicot ..... 200/11 DA
4,391,845 A * 7/1983 Denley ..... 427/58
5,605,223 A * 2/1997 Gutmann et al. ..... 200/275
5,810,604 A * 9/1998 Kopp, Jr. et al. ..... 434/317

* cited by examiner

*Primary Examiner*—Elvin Enad
*Assistant Examiner*—Kyung S. Lee
(74) *Attorney, Agent, or Firm*—Jimmy L. Funke

(57) ABSTRACT

A resistive surface pad 10 is provided, including a first upper contact surface 32, a second upper contact surface 34, a first lower contact surface 38 and a second lower contact surface 40. The first upper contact surface 32 and the second upper contact surface 34 are shaped to form a generally arc-shaped upper contact gap 36. The first lower contact surface 38 and the second lower contact surface 40 are shaped to form a generally arc-shaped lower contact gap 42. The second upper contact surface 34 and the second lower contact surface 40 are shaped to form a continuous, generally horizontal, center contact gap 44.

4 Claims, 1 Drawing Sheet

RESISTIVE SWITCH PAD

TECHNICAL FIELD

The present invention relates generally to a resistive switch pad and more particularly to a resistive switch pad with reduced intermittent responses.

BACKGROUND OF THE INVENTION

Resistive switch pads are well-known components used in electronic switches. Commonly, an actuator is used to create a closure across the pad and thereby activate the switch. Successful closure, however, depends upon the accuracy and planarity of the actuator s contact surface with the resistive switch pad. Often, due to variations in actuator materials and randomness in their motion, contact action between the actuator and the resistive switch pad seldom achieves either concentric centering or parallel planarity to the switch surface. Angular orientation of the initial actuator contact point may also vary. Desirable characteristics in switch pads are characteristics that maximize contact area and redundancy while minimizing impedance. By optimizing these characteristics, a resistive switch pad may be designed that limits intermittent responses. Intermittent responses result in inconsistent performance of the switch and are highly undesirable.

It would, therefore, be highly desirable to have a resistive switch pad that reduced incidents of intermittent responses. Furthermore, it would be desirable to have a resistive switch pad that was adaptive to various layout orientations while providing improved response to random angularity or non-centering of an actuator.

SUMMARY OF THE INVENTION

It is therefore an object of the present invention to provide a resistive switch pad that reduces intermittent responses. It is furthermore an object of the present invention to provide a resistive switch pad that is adaptive to layout orientations.

In accordance with the objects of the present invention, a resistive surface pad is provided. The resistive switch pad includes a first upper contact surface and a second upper contact surface. The first upper contact surface and the second upper contact surface are shaped to form a generally arc-shaped upper contact gap. The resistive switch pad also includes a first lower contact surface and a second lower contact surface. The first lower contact surface and the second lower contact surface are shaped to form a generally arc-shaped lower contact gap. The second upper contact surface and the second lower contact surface are shaped to form a continuous, generally horizontal, center contact gap.

Other objects and features of the present invention will become apparent when viewed in light of the detailed description of the preferred embodiment when taken in conjunction with the attached drawings and appended claims.

DESCRIPTION OF THE PREFERRED EMBODIMENT(S)

Figure 1:
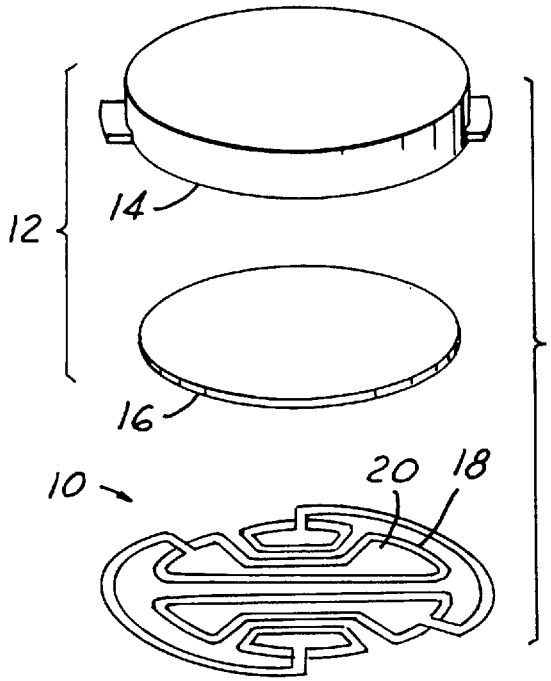
FIG. 1 is an illustration of an embodiment of a resistive switch pad in accordance with the present invention, the figure also illustrating a button and actuator.

Referring now to FIG. 1, which is an illustration of an embodiment of a resistive switch pad 10 in accordance with the present invention. FIG. 1 also includes an actuator assembly 12 including a button 14 and an actuator element 16. It should be understood that the resistive switch pad 10 is intended for use with a wide variety of actuator assemblies 12, and the actuator assembly 12 shown in FIG. 1 is strictly for illustrative purposes only. Known resistive switch pads can produce undesirable intermittent responses as well as undesirable sensitivity to actuator initial position and angular orientation. The present invention provides a resistive switch pad 10 with reduced intermittent responses, and a reduced sensitivity to actuator initial position or orientation.

Figure 2:
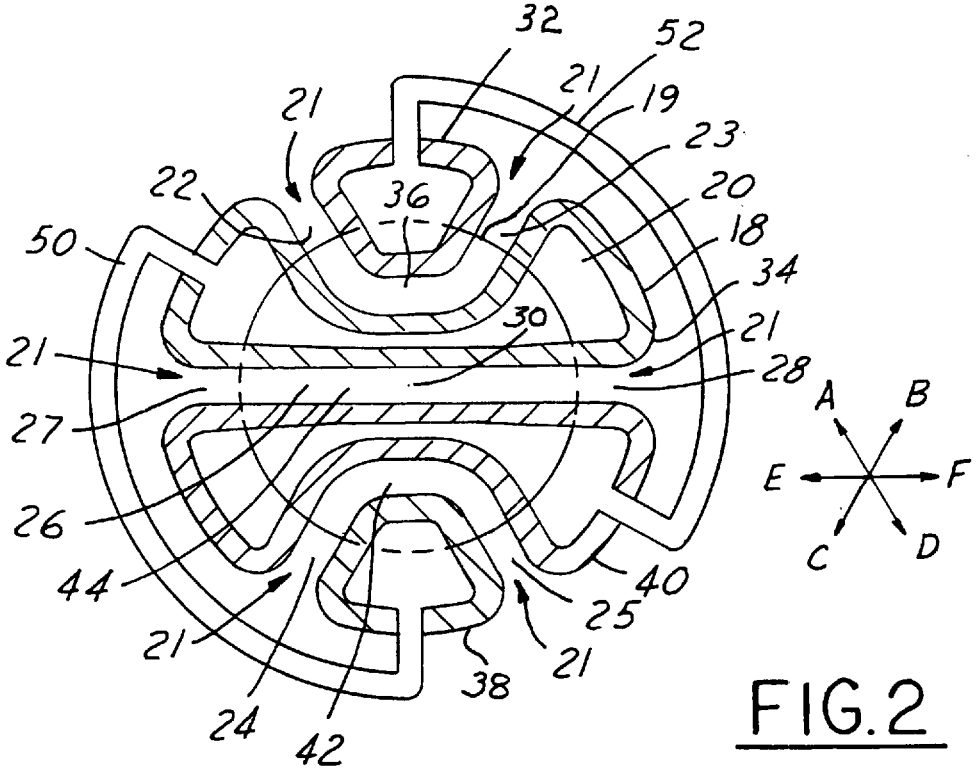
FIG. 2 is a detail of an embodiment of a resistive switch pad in accordance with the present invention.

Referring now to FIG. 2, which is an illustration of a resistive switch pad 10 in accordance with the present invention. Although the resistive switch pad 10 may be manufactured using a variety of methods, in one embodiment, the resistive switch pad 10 consists of carbon pads 18 printed over copper circuits 20. The use of carbon pads 18 over copper circuits 20 is a known switch pad manufacturing technique for providing useful single-sided layout connectivity. In addition, the use of carbon pads 18 printed over copper circuits 20 is known to benefit designs seeking uniform contact resistance.

The pads 18 are shaped and positioned to form contact gaps 21 that the actuator 16 can bridge, upon activation, to complete the circuit. A phantom line 19 is shown to illustrate the surface area of a circular actuator positioned above the resistive switch 10. The present invention includes a first upper contact gap 22 and a second upper contact gap 23, traveling at least partially in radial directions A,B away from the center of the resistive switch pad 10. The present invention further includes a first lower contact gap 24 and a second lower contact gap 25 traveling at least partially in radial directions C,D. Finally, the present invention includes a continuous center contact gap 26 which provides a first center contact gap 27 and a second center contact gap 28 traveling in radial directions E,F while further providing an active center 30. The present invention thereby provides contact gaps 21 in six radial directions A-F as well as an active center 30. By utilizing this layout of contact gaps 21, the present invention allows for enhanced flexibility and positioning of the actuator 16 while limiting incidences of intermittent responses. It should be understood that the radial directions AF are contemplated to encompass a wide variety of angles relative to each other. In addition, the present invention contemplates the use of additional contact gaps 21 in combination with those described. The pattern of contact gaps 21 provides an improvement over known designs by allowing the actuator 16 to bridge the contact gaps 21 by striking the resistive switch pad 10 in a variety of angles and positions.

Although a variety of configurations are contemplated in order to provide a plurality of radially directed contact gaps 22–28, along with a center contact gap 30, in one embodiment, the present invention contemplates the pattern illustrated in FIG. 2. The resistive switch pad 10 in this embodiment includes a first upper surface 32 and a second upper surface 34. The first upper contact surface 32 and the second upper contact surface 34 are shaped to form a generally arced upper contact gap 36. The present invention further includes a first lower contact surface 38 and a second lower contact surface 40 which are shaped to create a generally arced lower contact gap 42. The second upper contact surface 34 and the second lower contact surface 40 are shaped to form a continuous horizontal center contact gap 44. This embodiment is especially suitable for use with a circular actuator 16 by providing contact gaps 21 in six radial directions A–F while additionally providing an active center 30. In addition, although the copper circuits 20 may be formed in a variety of configurations, in one embodiment, the copper circuits 20 include a first external switch connection 50 and a second external switch connection 52. The second external switch connection 52, in this embodiment, connects the first upper contact surface 32 to the second lower contact surface 40 and the first external switch connection 50 connects the first lower contact surface 38 to the second upper contact surface 34. Although the first external switch connection 50 and the second external switch connection 52 may be formed in a variety of configurations, in one embodiment they are arc shaped. It should be understood that a wide variety of methods and configurations are contemplated for forming the copper circuits 20.

Throughout this application, the terms upper, lower, and horizontal have been utilized to describe elements of the present invention. It should be understood that these directional descriptive terms have only been used for illustrative purposes and are not intended to limit the present invention to a particular alignment. Although in one embodiment the resistive switch pad has a diameter of approximately 6 mm or a 0.25 inch, it is contemplated that the present invention can be scaled for diameter and/or contact surface spacing. In one embodiment, it is contemplated that the diameter of the actuator element 16 will be 3 mm although a given sized resistive switch pad 10 can be used with a wide variety of varying sized actuator elements 16 without modification. The present invention provides further utility due to its capabilities of being used in single-sided layout connectivity situations. The present invention also provides resistive switch pad area outlines that may be utilized in gold-plated, low impedance applications. Finally, the present invention provides cost effective and reliable resistive switch pad 10 that reduces intermittent responses and improves switch reliability. In this way, in addition to cost savings and customer satisfaction, the perception of quality is also improved.

While particular embodiments of the invention have been shown and described, numerous variations and alternate embodiments will occur to those skilled in the art. Accordingly, it is intended that the invention be limited only in terms of the appended claims.

What is claimed is:

1. A Resistive Switch Pad comprising:

a first upper contact surface;

a second upper contact surface, said second upper contact surface and said first upper contact surface shaped to form a generally arced upper contact gap;

a first lower contact surface;

a second lower contact surface, said second lower contact surface and said first lower contact surface shaped to form a generally arced lower contact gap;

wherein said second upper contact surface and said second lower contact surface shaped to form a continuous, generally horizontal, center contact gap;

wherein said upper contact gap, said lower contact gap and said center contact gap form contact gaps in six equally spaced radial directions.

2. A resistive switch pad comprising:

a plurality of contact surfaces forming:

a first upper radial contact gap;

a second upper radial contact gap;

a first lower radial contact gap;

a second lower radial contact gap;

a first center radial contact gap;

a second center radial contact gap; and an active center contact gap;

wherein said first upper radial contact gap, said second upper radial contact gap, said first lower radial contact gap, said second lower radial contact gap, said first center radial contact gap and said second center radial contact gap form contact gaps in six equally spaced radial directions.

3. A Resistive Switch Pad comprising:

a first upper contact surface;

a second upper contact surface, said second upper contact surface and said first upper contact surface shaped to form a generally arced upper contact gap;

a first lower contact surface;

a second lower contact surface, said second lower contact surface and said first lower contact surface shaped to form a generally arced lower contact gap;

wherein said second upper contact surface and said second lower contact surface shaped to form a continuous, generally horizontal, center contact gap;

a first external switch connection connecting said first lower contact surface to said second upper contact surface; and a second external switch connection connecting said first upper contact surface to said second lower contact surface.

4. A resistive switch pad as described in claim 3 wherein said first external switch connection and said second external switch connections are arc shaped.

* * * * *